US011427000B2

(12) United States Patent
Tanaka

(10) Patent No.: US 11,427,000 B2
(45) Date of Patent: Aug. 30, 2022

(54) LIQUID DISCHARGE HEAD

(71) Applicant: Brother Kogyo Kabushiki Kaisha, Aichi-Ken (JP)

(72) Inventor: Taiki Tanaka, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/235,511

(22) Filed: Apr. 20, 2021

(65) Prior Publication Data

US 2021/0331474 A1 Oct. 28, 2021

(30) Foreign Application Priority Data

Apr. 22, 2020 (JP) ..... JP2020-076266

(51) Int. Cl.
*B41J 2/14* (2006.01)

(52) U.S. Cl.
CPC ..... *B41J 2/14233* (2013.01); *B41J 2/14274* (2013.01); *B41J 2002/14241* (2013.01); *B41J 2002/14338* (2013.01); *B41J 2002/14491* (2013.01); *B41J 2202/01* (2013.01); *B41J 2202/12* (2013.01)

(58) Field of Classification Search
CPC ..... B41J 2/14233; B41J 2/14274; B41J 2002/14241; B41J 2002/14338; B41J 2002/14491; B41J 2202/01; B41J 2202/12
See application file for complete search history.

(56) References Cited

U.S. PATENT DOCUMENTS

| | | | | |
|---|---|---|---|---|
| 7,018,023 | B2 | 3/2006 | Shimada | |
| 9,315,021 | B2 * | 4/2016 | Nystrom | B41J 2/14233 |
| 2004/0130601 | A1 | 7/2004 | Shimada | |
| 2018/0287046 | A1 | 10/2018 | Hirai et al. | |

FOREIGN PATENT DOCUMENTS

| | | | |
|---|---|---|---|
| JP | 2005-088560 | A | 4/2005 |
| JP | 2018-167576 | A | 11/2018 |

* cited by examiner

*Primary Examiner* — Geoffrey S Mruk
(74) *Attorney, Agent, or Firm* — Banner & Witcoff, Ltd.

(57) ABSTRACT

There is provided a liquid discharge head including: a channel unit; a piezoelectric actuator; and a protective member. Pressure chambers form pairs of the pressure chambers arranged in a second direction. Each of the pressure chamber pairs includes a first pressure chamber and a second pressure chamber that communicate with an identical nozzle via a communication channel. The protective member includes first partition walls joined to a surface at a first side in a first direction of the piezoelectric actuator and separating accommodating spaces from each other. Each of the first partition walls is provided between the first pressure chamber and the second pressure chamber, which belong to different pressure chamber pair, in the second direction. Each of the first partition walls is not provided between the first pressure chamber and the second pressure chamber, which belong to an identical pressure chamber pair, in the second direction.

7 Claims, 9 Drawing Sheets

LIQUID DISCHARGE HEAD

CROSS REFERENCE TO RELATED APPLICATION

The present application claims priority from Japanese Patent Application No. 2020-076266 filed on Apr. 22, 2020, the disclosure of which is incorporated herein by reference in its entirety.

BACKGROUND

Field of the Invention

The present disclosure relates to a liquid discharge head configured to discharge liquid from nozzles.

Description of the Related Art

As an exemplary liquid discharge head configured to discharge liquid from nozzles, there is publicly known a recording head configured to jet ink from nozzles. In a publicly known recording head, an elastic film covering pressure chambers is disposed on an upper surface of a pressure chamber forming substrate in which the pressure chambers are aligned in rows. Piezoelectric elements are arranged in parts of an upper surface of the elastic film overlapping in an up-down direction with the respective pressure chambers. The piezoelectric elements apply discharge energy for discharging ink from nozzles that communicate with the pressure chambers to the ink in the pressure chambers. A protective substrate covering the piezoelectric elements is disposed on the upper surface of the elastic film, and the piezoelectric elements are accommodated in a space formed by the protective substrate.

SUMMARY

When ink viscosity is high, discharge energy required for discharging ink from nozzles is large. However, in the liquid discharge head, there may be a demand for a decrease in size of pressure chambers in order to arrange the nozzles densely and downsize an apparatus. In a configuration in which the size of the pressure chambers is small and one nozzle communicates with one pressure chamber like the publicly known recording head, sufficient discharge energy may not be applied to the ink. Thus, an inventor of the present disclosure has considered that the discharge energy is increased by allowing one nozzle to communicate with two adjacent pressure chambers and driving two piezoelectric elements that correspond to the two pressure chambers at the same time.

However, in this case, since two piezoelectric elements are driven at the same time, parts of the electric film overlapping with the two piezoelectric elements are deformed at the same time. This increases the effect of crosstalk. The crosstalk is a phenomenon in which deformation of a part of a vibration film overlapping with a certain pressure chamber is transmitted to a part of the vibration film overlapping with another pressure chamber, thus leading to the change in discharge characteristics of the liquid in a nozzle communicating with the another pressure chamber.

An object of the present disclosure is to provide a liquid discharge head that is capable of applying sufficient discharge energy to liquid and inhibiting the effect of crosstalk as much as possible.

According to an aspect of the present disclosure, there is provided a liquid discharge head, including: a channel unit including a liquid channel that includes a plurality of pairs of pressure chambers; a piezoelectric actuator disposed at a first side in a first direction of the channel unit, the piezoelectric actuator including: a plurality of piezoelectric elements overlapping with the pressure chambers in the first direction; and a vibration film disposed between the piezoelectric elements and the channel unit in the first direction and covering the pressure chambers, and a protective member joined to a surface, of the piezoelectric actuator, at the first side in the first direction and forming a plurality of accommodation spaces in which the piezoelectric elements are accommodated. The plurality of pairs of the pressure chambers are arranged in a second direction that is orthogonal to the first direction, each of the pairs of the pressure chambers includes a first pressure chamber and a second pressure chamber disposed at a first side in the second direction of the first pressure chamber. The liquid channel includes: a plurality of nozzles respectively corresponding to the pairs of the pressure chambers; and a plurality of communication channels respectively corresponding to the pairs of the pressure chambers, each of the communication channels allowing the first pressure chamber, the second pressure chamber, and the nozzle to communicate with each other. The protective member includes a plurality of first partition walls joined to the surface at the first side in the first direction of the piezoelectric actuator and separating the accommodating spaces from each other, and each of the first partition walls is provided between a first pressure chamber and a second pressure chamber, which belong to different pairs of the pressure chambers included in the pairs of the pressure chambers, in the second direction, and each of the first partition walls is not provided between a first pressure chamber and a second pressure chamber, which belong to an identical pressure chamber pair included in the pairs of the pressure chambers, in the second direction.

DESCRIPTION OF THE EMBODIMENTS

An embodiment of the present disclosure is explained below.

<Printer 100>

Figure 1:
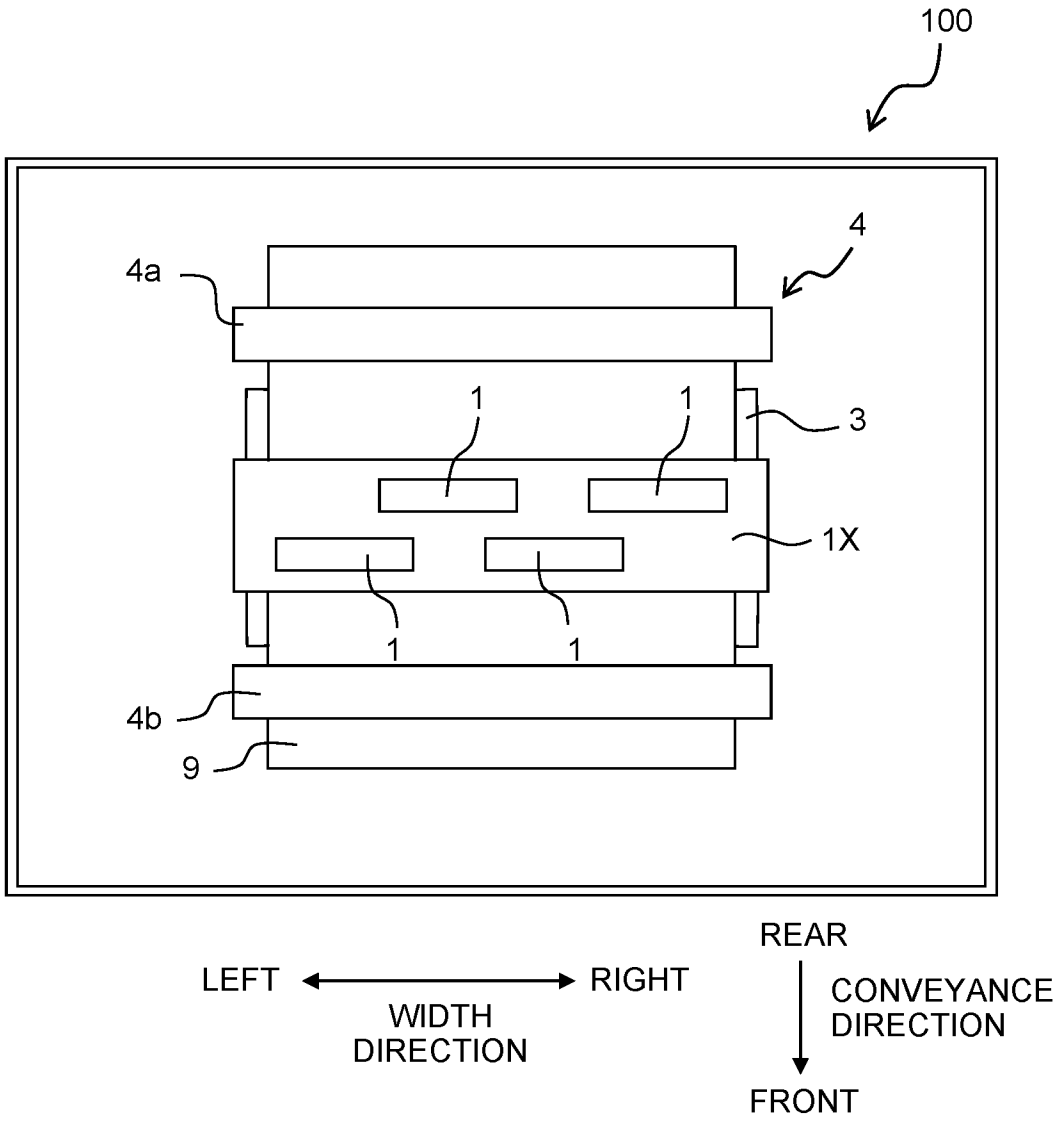
FIG. 1 is a plan view of a printer provided with ink-jet heads.

As depicted in FIG. 1, a printer 100 of this embodiment includes a head unit 1*x* including four ink-jet heads 1 (a "liquid discharge head" of the present disclosure), a platen 3, and a conveyor 4.

The head unit 1*x* is long in a horizontal width direction (a "second direction" of the present disclosure). The head unit 1*x* is a so-called line head that discharges ink from nozzles 22 (see FIGS. 2 to 4) to a sheet 9 with a position of the head unit 1*x* being fixed. The four ink-jet heads 1 are long in the width direction. Of the four ink-jet heads 1, two ink-jet heads 1 are arranged in the width direction. Remaining two ink-jet heads 1 are arranged in the width direction at positions shifted in a horizontal conveyance direction, which is orthogonal to the width direction, from the two ink-jet heads 1. Of the four ink-jet heads 1, the two ink-jet heads 1 arranged in the width direction are shifted in the width direction from the remaining two ink-jet heads 1 arranged in the width direction.

In the following explanation, right and left sides in the width direction are defined as indicated in FIG. 1. Further, front and rear sides in the conveyance direction are defined as indicated in FIG. 1.

The platen 3 is disposed below the head unit 1*x* to face the nozzles 22 of the four ink-jet heads 1. The sheet 9 is placed on an upper surface of the platen 3.

The conveyor 4 includes two roller pairs 4*a* and 4*b* arranged to interpose the platen 3 therebetween in the conveyance direction. The roller pairs 4*a* and 4*b* rotate while nipping the sheet 9, and conveys the sheet 9 in the conveyance direction.

<Ink-Jet Head 1>

A configuration of the ink-jet head 1 is explained below. As depicted in FIGS. 2 to 5, the ink-jet head 1 includes a channel unit 11, a piezoelectric actuator 12, a protective member 13, a manifold substrate 14, and a trace substrate 18.

The channel unit 11 is configured by stacking three plates 11*a* to 11*c* in a vertical direction (a "first direction" of the present disclosure). The three plates 11*a* to 11*c* adhere to each other by adhesive. The plates 11*a* to 11*c* are formed, for example, by resin or metal such as stainless steel. Individual channels 20 are formed in the plates 11*a* to 11*c*. In this embodiment, an upper side in the vertical direction corresponds to a "first side in the first direction" of the present disclosure.

Figure 2:
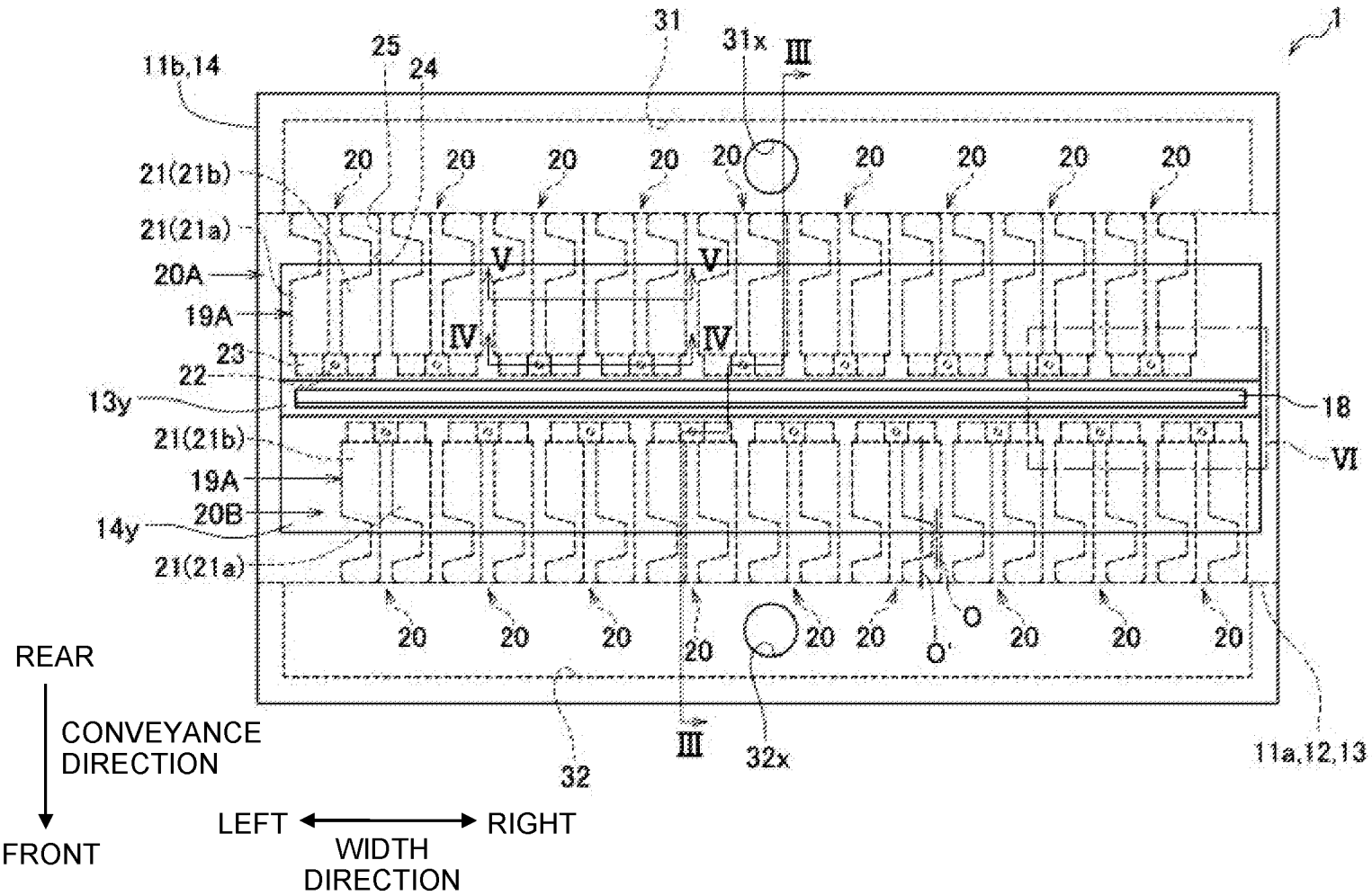
FIG. 2 is a plan view of the ink-jet head.

As depicted in FIG. 2, the individual channels 20 form individual channel rows 20A and 20B. Each of the individual channel rows 20A and 20B includes the individual channels 20 arranged in the width direction. The individual channel rows 20A and 20B are arranged in the conveyance direction at an interval. The individual channel row 20B is positioned at the front side of the individual channel row 20A in the conveyance direction. It is assumed that an interval in the width direction between the individual channels 20 in each of the individual channel rows 20A and 20B is P. In this case, the individual channels 20 forming the individual channel row 20A are shifted in the width direction from the individual channels 20 forming the individual channel row 20B by a length of P/2.

As depicted in FIG. 2, each individual channel 20 includes two pressure chambers 21 (a first pressure chamber 21*a* and a second pressure chamber 21*b*), one of the nozzles 22, a communication channel 23, and two narrow channels 24, and two wide channels 25.

The pressure chamber 21 has a substantially rectangular shape that is long in the conveyance direction as viewed in the vertical direction. The second pressure chamber 21*b* is adjacent to a first side in the width direction of the first pressure chamber 21*a*. In the individual channels 20 forming the individual channel row 20A, the first side in the width direction corresponds to the right side. In the individual channels 20 forming the individual channel row 20B, the first side in the width direction corresponds to the left side. In the following, the left side in the individual channels 20 forming the individual channel row 20A and the right side in the individual channels 20 forming the individual channel row 20B correspond to a second side in the width direction.

A pressure chamber row 19A includes the first pressure chambers 21*a* and the second pressure chambers 21*b* corresponding to the individual channel row 20A. In the pressure chamber row 19A, the first pressure chambers 21*a* and the second pressure chambers 21*b* are arranged alternately in the width direction. A pressure chamber row 19B includes the first pressure chambers 21*a* and the second pressure chambers 21*b* corresponding to the individual channel row 20B. In the pressure chamber row 19B, the first pressure chambers 21*a* and the second pressure chambers 21*b* are arranged alternately in the width direction.

An end at a first side in the conveyance direction of the pressure chamber 21 is connected to the communication channel 23, and an end at a second side in the conveyance direction of the pressure chamber 21 is connected to the narrow channel 24. In the individual channel row 20A, the first side in the conveyance direction corresponds to the front side in the conveyance direction. In the individual channel row 20B, the first side in the conveyance direction corresponds to the rear side in the conveyance direction. In the individual channel row 20A, the second side in the conveyance direction corresponds to the rear side in the conveyance direction. In the individual channel row 20B, the second side in the conveyance direction corresponds to the front side in the conveyance direction.

As depicted in FIG. 2, the narrow channel 24 has a width narrower than the pressure chamber 21 (a length in the width direction of the narrow channel 24 is shorter than that of the pressure chamber 21). The narrow channel 24 functions as a throttle. A center line O in the width direction of the narrow channel 24 is positioned at the right side in the width direction with respect to a center line O' in the width direction of the pressure chamber 21 corresponding thereto.

An end at the second side in the conveyance direction of the narrow channel 24 is connected to the wide channel 25. A width of the wide channel 25 (length in the width direction of the wide channel 25) is substantially the same as the width of the pressure chamber 21. A center line in the width direction of the wide channel 25 is coincident with the center line O' in the width direction of the pressure chamber 21 corresponding thereto.

Figure 3:
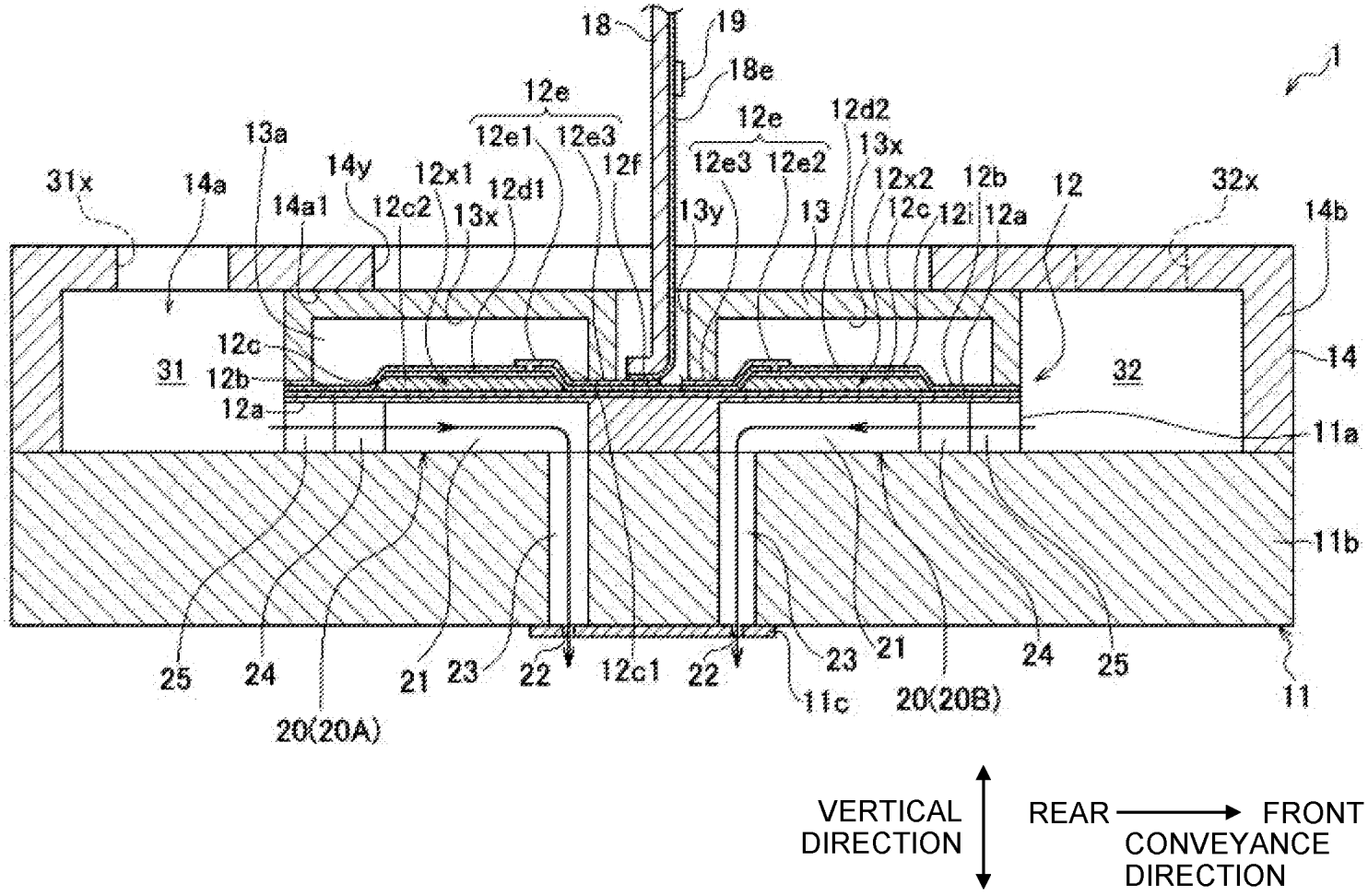
FIG. 3 is a cross-sectional view of the ink-jet head taken along a line III-III in FIG. 2.

As depicted in FIG. 3, the pressure chambers 21, the narrow channels 24, and the wide channels 25 are defined by recesses that are opened in a lower surface of the plate 11*a* (a "pressure chamber member" of the present disclosure".

Each part of the plate 11*a* between the first pressure chamber 21*a* and the second pressure chamber 21*b* that is adjacent to the first side in the width direction of the first pressure chamber 21*a* is formed having a second partition wall 11*a*1 that separates the first pressure chamber 21*a* from the second pressure chamber 21*b*. Similarly, each part of the plate 11*a* between the first pressure chamber 21*a* and the second pressure chamber 21*b* that is adjacent to the second side in the width direction of the first pressure chamber 21*a* is forming having a second partition wall 11*a*2 that separates the first pressure chamber 21*a* from the second pressure chamber 21*b*.

The nozzles 22 are formed by through holes formed in the plate 11*c*. The nozzle 22 is positioned at a center portion between the first pressure chamber 21*a* and the second pressure chamber 21*b* in the width direction. The nozzle 22 overlaps with the second partition wall 11*a*1 in the vertical direction.

Figure 4:
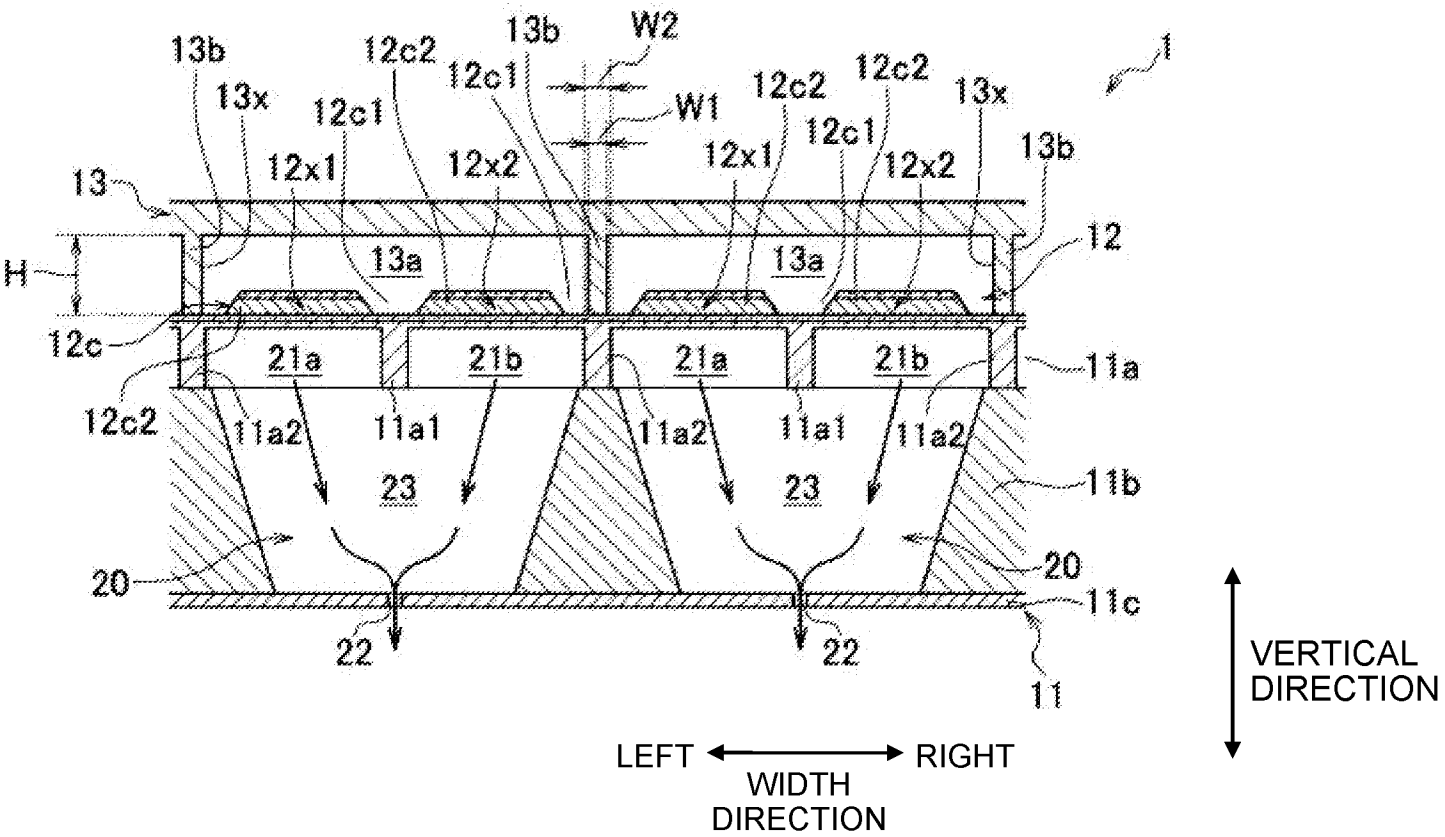
FIG. 4 is a cross-sectional view of the ink-jet head taken along a line IV-IV in FIG. 2.
Figure 5:
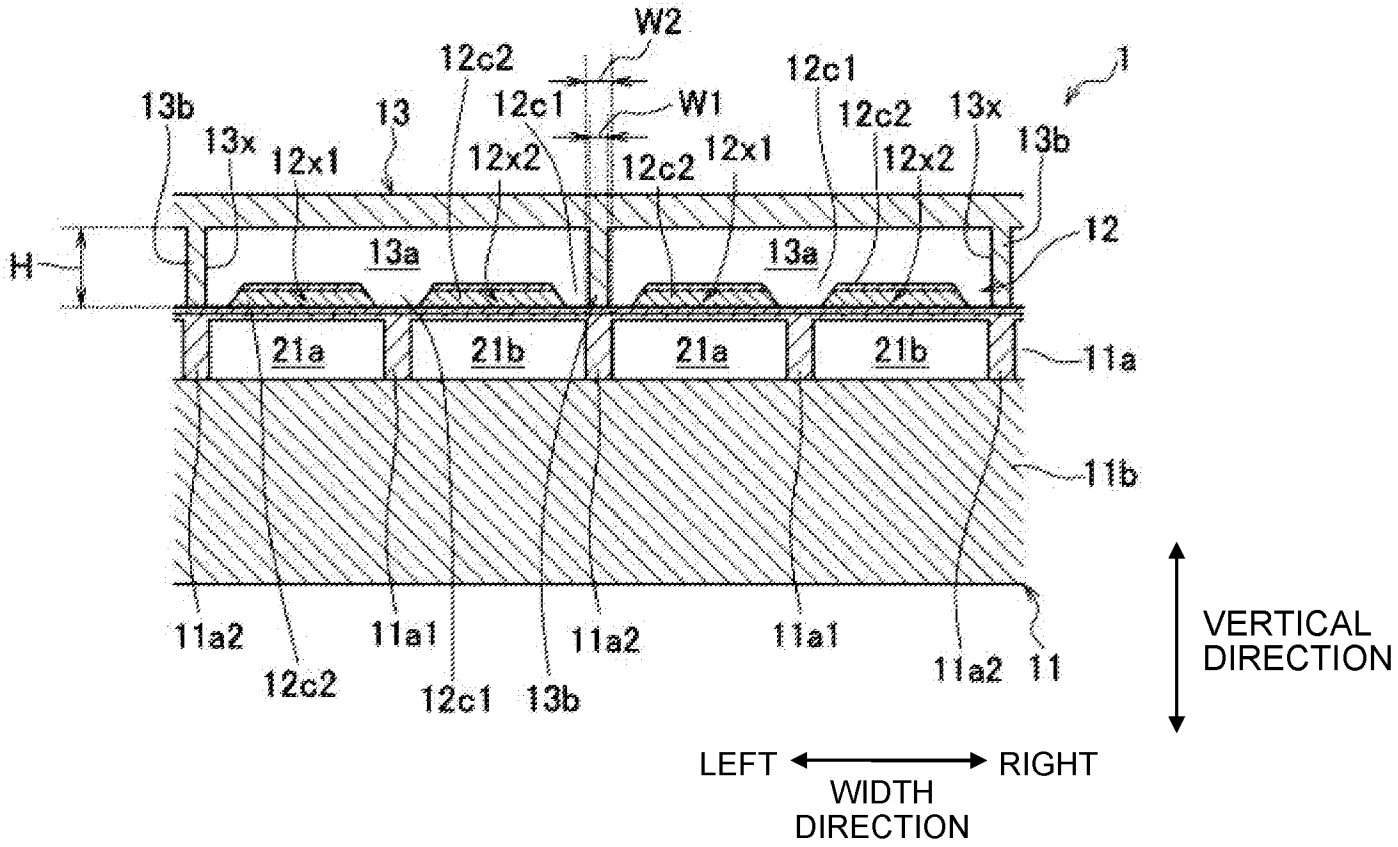
FIG. 5 is a cross-sectional view of the ink-jet head taken along a line V-V in FIG. 2.

As depicted in FIGS. 3 and 4, the communication channels 23 are formed by through holes formed in the plate 11*b*. The communication channel 23 extends in the vertical direction. The communication channel 23 has a tapered shape in which its length in the width direction is shorter toward the lower side in the vertical direction. An upper end of the communication channel 23 is connected to the first pressure chamber 21*a* and the second pressure chamber 21*b*. A lower end of the communication channel 23 is connected to the nozzle 22. Thus, in each individual channel 20, the first pressure chamber 21*a*, the second pressure chamber 21*b*, and the nozzle 22 communicate with each other via the communication channel 23.

As depicted in FIG. 3, the piezoelectric actuator 12 is disposed on an upper surface of the plate 11*a*. The piezoelectric actuator 12 includes a vibration film 12*a*, a common electrode 12*b*, a piezoelectric layer 12*c*, and individual electrodes 12*d*1 and 12*d*2. The vibration film 12*a*, the common electrode 12*b*, the piezoelectric layer 12*c*, and the individual electrodes 12*d*1 and 12*d*2 are stacked in this order from below. The shape of the piezoelectric actuator 12 as viewed in the vertical direction is the same as the shape of the plate 11*a* as viewed in the vertical direction. In the following explanation, the shape of a member as viewed in the vertical direction is referred to as an external form of the member. In this embodiment, the external form of the plate 11*a* overlaps completely with the external form of the piezoelectric actuator 12 in the vertical direction.

The vibration film 12*a* is formed by an upper end of the plate 11*a*. The vibration film 12*a* covers all the pressure chambers 21*a* and 21*b*. The common electrode 12*b* is disposed over an entire area of the upper surface of the plate 11*a* to cover all the pressure chambers 21*a* and 21*b* formed in the plate 11*a*. The vibration film 12*a* has, for example, a thickness of approximately 10 μm. The common electrode 12*b* has, for example, a thickness of approximately 0.2 μm.

The piezoelectric layer 12*c* is disposed above the vibration film 12*a* and the common electrode 12*b*. The piezoelectric layer 12*c* has, for example, a thickness of approximately 1 μm. In the piezoelectric layer 12*c*, slits 12*c*1 are formed in parts overlapping in the vertical direction with the second partition walls 11*a*1 and 11*a*2, a part positioned between the individual channel row 20A and the individual channel row 20B in the conveyance direction, and the like. In this configuration, the piezoelectric layer 12*c* is divided into piezoelectric bodies 12*c*2 corresponding to the respective pressure chambers 21. Each of the piezoelectric bodies 12*c*2 overlaps in the vertical direction with the corresponding one of the pressure chambers 21.

The individual electrodes 12*d*1 overlap in the vertical direction with the first pressure chambers 21*a*. The individual electrodes 12*d*2 overlap in the vertical direction with the second pressure chambers 21*b*. The individual electrodes 12*d*1 and 12*d*2 have, for example, a thickness of approximately 0.2 μm.

The piezoelectric actuator 12 further includes an insulating film 12*i* and traces 12*e*.

The insulating film 12*i* is formed, for example, by silicon dioxide ($SiO_2$). The insulating film 12*i* covers parts included in an upper surface of the common electrode 12*b* and not provided with the piezoelectric bodies 12*c*2, side surfaces of the piezoelectric bodies 12*c*2, and upper surfaces of the individual electrodes 12*d*1 and 12*d*2. Through holes are provided in parts of the insulating film 12*i* overlapping in the vertical direction with the individual electrodes 12*d*1 and 12*d*2. The insulating film 12*i* has, for example, a thickness of approximately 0.1 μm.

Figure 6:
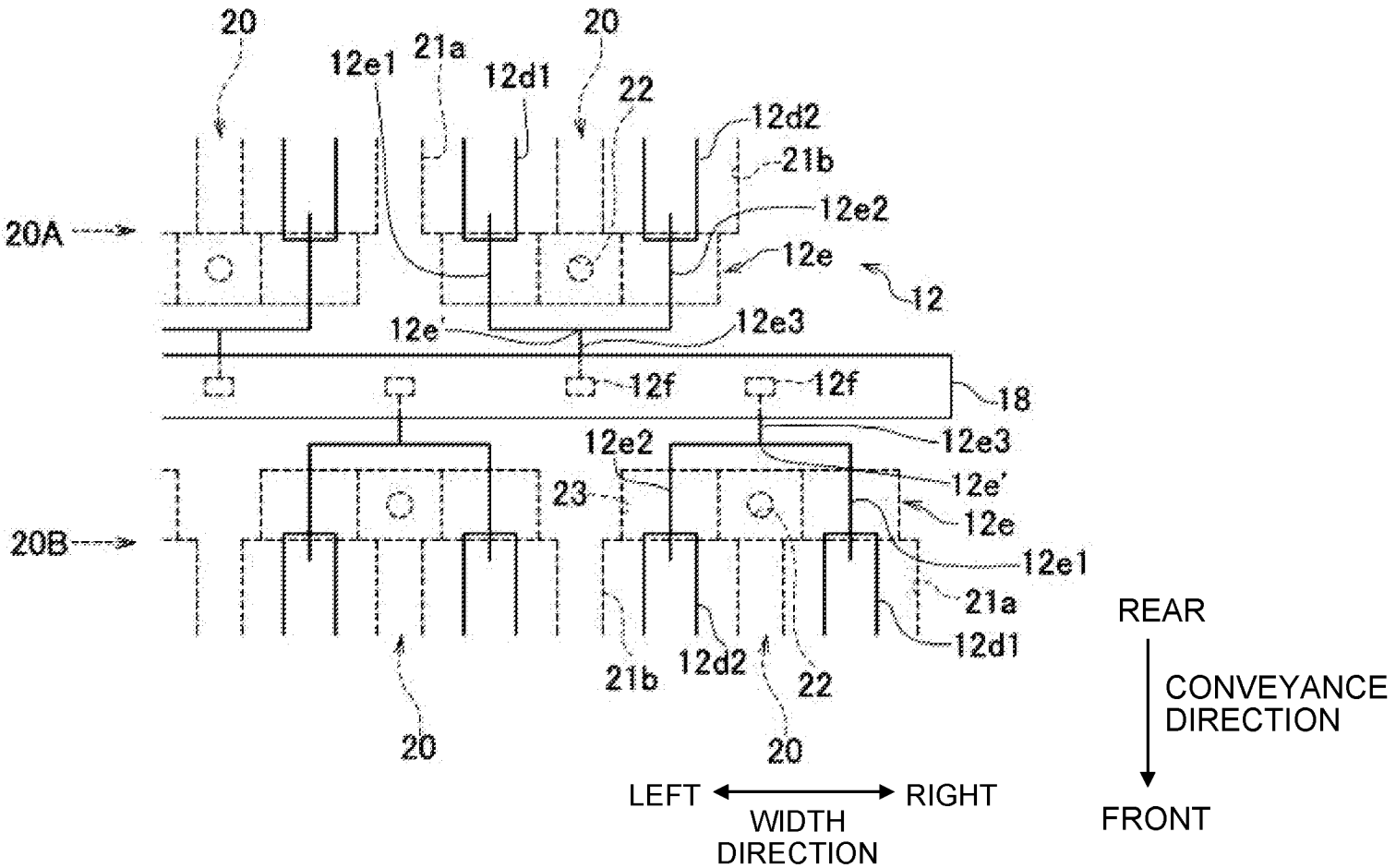
FIG. 6 is an enlarged view of an area VI depicted in FIG. 2.

The traces 12*e* are formed on the insulating film 12*i*. The traces 12*e* have, for example, a thickness of approximately 0.2 μm. As depicted in FIG. 6, the traces 12*e* correspond to the respective individual channels 20. The trace 12*e* has a first portion 12*e*1 having a L-shape and connected to the individual electrode 12*d*1, a second portion 12*e*2 having a L-shape and connected to the individual electrode 12*d*2 and the first portion 12*e*1, and a third portion 12*e*3 extending in the conveyance direction from a connection portion 12*e*' between the first portion 12*e*1 and the second portion 12*e*2. As depicted in FIG. 3, ends of the first portion 12*e*1 and the second portion 12*e*2 are inserted into the through holes of the insulating film 12*i*, so that the first portion 12*e*1 and the second portion 12*e*2 are electrically connected to the individual electrodes 12*d*1 and 12*d*2, respectively. The third portion 12*e*3 is pulled out in the conveyance direction to a part of the piezoelectric actuator 12 between the individual channel row 20A and the individual channel row 20B (between the pressure chamber row 19A and the pressure chamber row 19B) in the conveyance direction. An end of the third portion 12*e*3 is a contact 12*f*.

Parts of the piezoelectric actuator 12 that are disposed on the upper surface of the vibration film 11 and overlap in the vertical direction with the respective first pressure chambers 21*a* are piezoelectric elements 12*x*1. Parts of the piezoelectric actuator 12 that are disposed on the upper surface of the vibration film 11 and overlap in the vertical direction with the respective second pressure chambers 21*b* are piezoelectric elements 12*x*2.

In this embodiment, the two individual electrodes 12*d*1 and 12*d*2 corresponding to one of the individual channels 20 are electrically connected to each other. Thus, the electrical potential of the two individual electrodes 12*d*1 and 12*d*2 corresponding to one of the individual channels 20 changes in a similar manner. That is, the same driving signal is applied to the piezoelectric elements 12*x*1 and 12*x*2.

As depicted in FIG. 3, the protective member 13 adheres to an upper surface of the piezoelectric actuator 12. The protective member 13, the plate 11*a*, and the piezoelectric actuator 12 have the same external form. The external form of the protective member 13 overlaps completely with the external form of the plate 11*a* and the external form the piezoelectric actuator 12 in the vertical direction. The protective member 13 is formed having recesses 13*x* and a through hole 13*y*.

The recesses 13*x* correspond to the respective individual channels 20. The recesses 13*x* corresponding to the individual channel row 20A and the recesses 13X corresponding to the individual channel row 20B are arranged in the width direction. Spaces formed by the recesses 13*x* are referred to as accommodation spaces 13*a*. Each accommodation space 13*a* accommodates the two piezoelectric elements 12*x*1 and 12*x*2 corresponding to one of the individual channels 20. A part of the protective member 13 between adjacent recesses 13*x* is a first partition wall 13*b* that separates the accommodation spaces 13*a* from each other. A width W1 (a length in the width direction) of the first partition wall 13*b* is shorter than a width W2 of the second partition walls 11*a*1 and 11*a*2. For example, the width W1 is approximately 10 μm, and the width W2 is approximately 14 μm. Further, a height H of the first partition wall 13*b* is equal to or more than 10 μm and equal to or less than 30 μm.

Each first partition wall 13*b* adheres to a part of the upper surface of the piezoelectric actuator 12 positioned between the piezoelectric element 12*x*1 and the piezoelectric element 12*x*2. Each part of the upper surface of the piezoelectric actuator 12 positioned between the piezoelectric element 12*x*1 and the piezoelectric element 12*x*2 (each part adhering to the first partition wall 13*b*) is flat.

The through hole 13*y* is formed in a center portion in the conveyance direction of the protective member 13. The through hole 13*y* extends in the width direction over the contacts 12*f* to overlap in the vertical direction with the contacts 12*f*.

The manifold substrate 14 is disposed on an upper surface of a stacking body formed by the channel unit 11, the piezoelectric actuator 12, and the protective member 13. A lower surface of the manifold substrate 14 is formed having a recess 14*a*. The recess 14*a* extends over a substantially entire area of the manifold substrate 14 in the width direction and the conveyance direction. The plate 11*b* extends toward both sides in the conveyance direction beyond the plate 11*a*. Walls 14*b* defining both ends in the conveyance direction of the recess 14*a* of the manifold substrate 14 adhere to both ends in the conveyance direction of an upper surface of the plate 11*b*. The plate 11*a*, the piezoelectric actuator 12, and the protective member 13 are accommodated in the recess 14*a*, and an upper surface of the protective member 13 is joined to a ceiling surface 14*a*1 of the recess 14*a*.

The manifolds 31 and 32 are formed by disposing the manifold substrate 14 on the upper surface of the stacking body, which is formed by the channel unit 11, the piezoelectric actuator 12, and the protective member 13. The manifold 31 is defined by end surfaces at the rear side in the conveyance direction of the plate 11*a*, the piezoelectric actuator 12, and the protective member 13, the upper surface of the plate 11*b*, the ceiling surface 14*a*1, an end surface at the rear side in the conveyance direction of the recess 14*a*, and both end surfaces in the width direction of the recess 14*a*. The manifold 31 extends in the width direction. The manifold 31 is connected to the wide channels 25 forming the individual channel row 20A.

The manifold 32 is defined by end surfaces at the front side in the conveyance direction of the plate 11*a*, the piezoelectric actuator 12, and the protective member 13, the upper surface of the plate 11*b*, the ceiling surface 14*a*1, an end surface at the front side in the conveyance direction of the recess 14*a*, and end surfaces at both sides in the width direction of the recess 14*a*. The manifold 32 extends in the width direction. The manifold 32 is connected to the wide channels 25 forming the individual channel row 20B.

The manifolds 31 and 32 communicate with a subtank (not depicted) via supply openings 31*x* and 32*x* formed at an upper end of the manifold substrate 14. The subtank communicates with a main tank storing ink. The subtank stores ink supplied from the main tank. Ink in the subtank flows into the manifolds 31 and 32 from the supply openings 31*x* and 32*x*. Ink flowing into the manifold 31 is supplied to the respective individual channels 20 forming the individual channel row 20A. Ink flowing into the manifold 32 is supplied to the respective individual channels 20 forming the individual channel row 20B.

A part of the manifold substrate 14 overlapping in the vertical direction with the through hole 13*y* of the protective member 13 is formed having a through hole 14*y*. The contacts 12*f* are exposed through the through holes 13*y* and 14*y*.

The trace substrate 18 is, for example, a Chip On Film (COF). A lower end of the trace substrate 18 is joined to a center portion in the conveyance direction of the upper surface of the piezoelectric actuator 12. The lower end of the trace substrate 18 extends in the width direction (see FIGS. 2 and 6) on the upper surface of the piezoelectric actuator 12. The trace substrate 18 includes individual traces 18*e* (see FIG. 3) electrically connected to the respective contacts 12*f* and a common trace (not depicted). The individual traces 18*e* correspond to the respective individual channels 20. The common trace is electrically connected to the common electrode 12*b* via a through hole provided for the insulating film 12*i*. The common electrode 12*b* is connected to a power source (not depicted) via the common trace and kept at a ground potential.

As depicted in FIG. 3, the trace substrate 18 extends upward from the upper surface of the piezoelectric actuator 12 through the through holes 13*y* and 14*y*. An upper end of the trace substrate 18 is connected to a control substrate (not depicted). The driver IC 19 is mounted on the trace substrate 18.

The driver IC 19 is electrically connected to the individual electrodes 12*d*1 and 12*d*2 via the individual traces 18*e*. The driver IC 19 generates a driving signal based on a control signal from the control substrate (not depicted) and applies the driving signal to the individual electrodes 12*d*1 and 12*d*2. This switches the electrical potential of the individual electrodes 12*d*1 and 12*d*2 between a predefined driving potential and the ground potential. This deforms parts included in the vibration film 12*a* and the piezoelectric bodies 12*c*2 and overlapping in the vertical direction with the pressure chambers 21*a* and 21*b*, thus changing the volume of the pressure chambers 21*a* and 21*b*. Pressure is thus applied to ink in the pressure chambers 21*a* and 21*b*, and ink is discharged from the nozzles 22.

In FIG. 6, illustration of the protective member 13 is omitted.

Effects of this Embodiment

In this embodiment, when ink is discharged from a certain nozzle 22, the piezoelectric elements 12*x*1 and 12*x*2 corresponding to two pressure chambers (the first pressure chamber 21*a* and the second pressure chamber 21*b*) that communicate with the certain nozzle 22 are driven at the same time. This makes it possible to apply sufficient discharge energy to ink.

The first partition wall 13*b* of the protective member 13 is joined to a part of the piezoelectric actuator 12 positioned between a certain first pressure chamber 21*a* and a pressure chamber 21*b* adjacent to the second side in the width direction of the certain first pressure chamber 21*a* (second pressure chamber 21*b* not communicating with the same nozzle 22). Thus, the part of the piezoelectric actuator 12 overlapping in the vertical direction with the first partition wall 13*b* is not likely to be deformed by being sandwiched by the second partition wall 11*a*2 and the first partition wall 13*b*. In this configuration, deformation of a part of the piezoelectric actuator 12 overlapping in the vertical direction with the pressure chamber 21 forming a certain individual channel 20 is not likely to be transmitted to a part overlapping in the vertical direction with the pressure chamber 21 forming another individual channel 20. That is, it is possible to inhibit so-called cross talk in which the deformation of the part of the piezoelectric actuator 12 overlapping in the vertical direction with the pressure chamber 21 forming the certain individual channel 20 is transmitted to the part overlapping in the vertical direction with the pressure chamber 21 forming another individual channel 20.

A part of the piezoelectric actuator 12 positioned between a certain first pressure chamber 21*a* and a second pressure chamber 21*b* adjacent to the first side in the width direction of the certain first pressure chamber 21*a* (the second pressure chamber 21*b* communicating with the same nozzle 22) is not joined to the first partition wall 13*b*. Thus, when the piezoelectric elements 12*x*1 and 12*x*2 corresponding to the first pressure chamber 21*a* and the second pressure chamber 21*b* that communicate with the same nozzle 22 are driven at the same time, the deformation of parts of the vibration film 12*a* overlapping with the first pressure chamber 21*a* and the second pressure chamber 21*b* is not obstructed by the first partition wall 13*b*.

In this embodiment, the width W1 of the first partition wall 13*b* is narrower than the width W2 of the second partition wall 11*a*2. In this configuration, when the protective member 13 is joined to the upper surface of the piezoelectric actuator 12, and when the position of the protective member 13 is slightly shifted in the width direction from the channel unit 11 and the piezoelectric actuator 12, the first partition wall 13*b* is not likely to extend beyond the second partition wall 11*a*2, that is, the first partition wall 13*b* is not likely to overlap in the vertical direction with the pressure chamber 21. Accordingly, it is possible to inhibit the change in ink discharge characteristics discharged from the nozzle 20 at the time of driving the piezoelectric elements 12*x*1 and 12*x*2 which may be otherwise by caused by the position shift described above.

In this embodiment, since the height H of the first partition walls 13*b* is equal to or more than 10 μm, the height of the accommodation spaces 13*a* is also equal to or more than 10 μm. Thus, when the parts of the piezoelectric actuator 12 overlapping in the vertical direction with the pressure chambers 21 are deformed by driving the piezoelectric elements 12*x*1 and 12*x*2, the piezoelectric elements 12*x*1 and 12*x*2 do not interfere with the protective member 13. Further, since the height H of the first partition walls 13*b* is equal to or less than 30 μm, the rigidity of the first partition walls 13*b* having the short width W1 is sufficient, and the first partition walls 13*b* are not likely to be damaged at the time of, for example, joining the protective member 13 and the piezoelectric actuator 12.

In this embodiment, the plate 11*a*, the piezoelectric actuator 12, and the protective member 13 have the same external form. The external forms of the plate 11*a*, the piezoelectric actuator 12, and the protective member 13 overlap completely with each other in the vertical direction. Thus, multiple stacking bodies each including the plate 11*a*, the piezoelectric actuator 12, and the protective member 13 can be produced by joining a member having a part to be formed as the plates 11*a*, a member having a part to be formed as the piezoelectric actuators 12, and a member having a part to be formed as the protective members 13 and then cutting this joined body. This reduces production costs of the ink-jet head 1.

In this embodiment, the traces 12*e* are pulled out from the piezoelectric elements 12*x*1 and 12*x*2 to the part of the piezoelectric actuator 12 between the individual channel row 20A and the individual channel row 20B in the conveyance direction. The ends of the traces 12*e* are the contacts 12*f*. Further, the through hole 13*y* extending over the contacts 12*f* is formed in the part of the protective member 13 positioned between the individual channel row 20A and the individual channel row 20B in the conveyance direction. Accordingly, the trace substrate 18 can be connected relatively easily to the contacts 12*f* through the through hole 13*y*.

In this embodiment, each part of the upper surface of the piezoelectric actuator 12 positioned between the piezoelectric element 12*x*1 and the piezoelectric element 12*x*2 adjacent to each other (each part adhering to the first partition wall 13*b*) is flat. Thus, when the first partition walls 13*b* of the protective member 13 are joined to parts of the upper surface of the piezoelectric actuator 12 overlapping in the vertical direction with the second partition walls 11*a*2, it is possible to uniformly apply load to the first partition walls 13*b*.

The embodiment of the present disclosure is explained above. The present disclosure is not limited to the above embodiment. Various changes or modifications in the embodiment may be made. Modified embodiments of the embodiment are described below. The modified embodiments described below can be combined as appropriate.

First Modified Embodiment

In the above embodiment, the slits 12*c*1 are formed in the parts of the piezoelectric layer 12*c* overlapping in the vertical direction with the second partition walls 11*a*1 and the parts of the piezoelectric layer 12*c* overlapping in the vertical direction with the second partition walls 11*a*2. The piezoelectric layer 12*c* is thus divided into the piezoelectric bodies 12*c*2 corresponding to the respective pressure chambers 21. The present disclosure, however, is not limited thereto.

Figure 7:
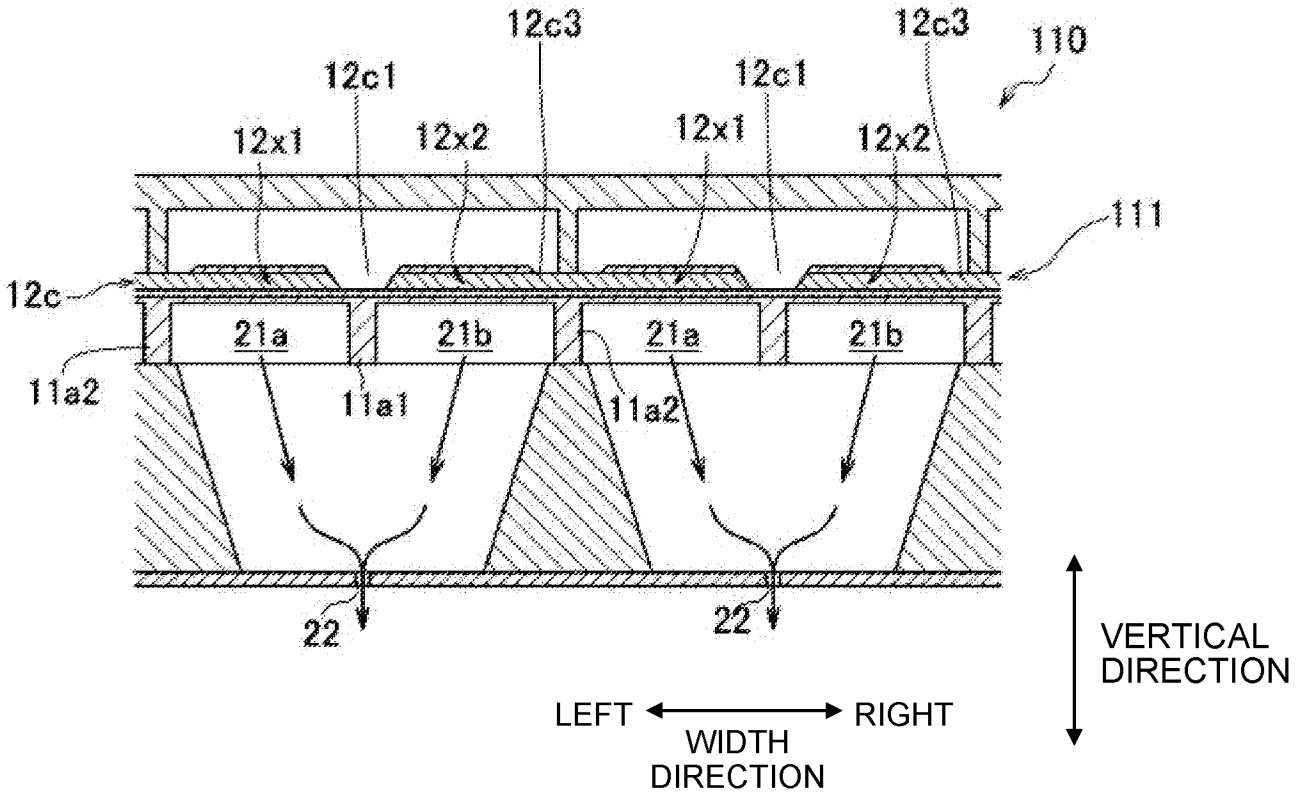
FIG. 7 is a cross-sectional view that corresponds to FIG. 4, depicting an ink-jet head according to a first modified embodiment.

For example, as depicted in FIG. 7, although the slits 12*c*1 are formed in parts of the piezoelectric layer 12*c* overlapping in the vertical direction with the second partition walls 11*a*1, no slits are formed in parts overlapping in the vertical direction with the second partition walls 11*a*2. Thus, the piezoelectric layer 12*c* is divided into piezoelectric bodies 12*c*3 each extending in the width direction over a certain first pressure chamber 21*a* and a second pressure chamber 21*b* adjacent to the second side in the width direction of the certain first pressure chamber 21*a*. Further, since no slits are formed in the parts of the piezoelectric layer 12*c* overlapping in the vertical direction with the second partition walls 11*a*2, each part of the upper surface of the piezoelectric layer 12*c* positioned between a certain first pressure chamber 21*a* and a second pressure chamber 21*b* adjacent to the second side in the width direction of the certain first pressure chamber 21*a* (i.e., each part of the upper surface of the piezoelectric layer 12*c* to which the first partition wall 13*b* is joined) is flat.

In a piezoelectric actuator 111 of an ink-jet head 110 according to a first modified embodiment, each slit 12*c*1 is formed in a part of the piezoelectric layer 12*c* positioned between a certain first pressure chamber 21*a* and a second pressure chamber 21*b* adjacent to the first side in the width direction of the certain first pressure chamber 21*a* (the second pressure chamber 21*b* communicating with the same nozzle 22). Thus, when the piezoelectric elements 12*x*1 and 12*x*2 corresponding to the two pressure chambers 21 are driven, the deformation of parts of the vibration film 11 overlapping in the vertical direction with the pressure chambers 21 is not likely to be obstructed by the piezoelectric layer 12*c*.

No slit 12*c*1 is formed in each part between a certain first pressure chamber 21*a* and a second pressure chamber 21*b* adjacent to the second side in the width direction of the certain first pressure chamber 21*a* (the second pressure chamber 21*b* not communicating with the same nozzle 22).

Thus, the thickness of a part of the piezoelectric actuator 111 positioned between the two pressure chambers 21 is large, thus increasing the rigidity of this part. In this configuration, the deformation of parts of the piezoelectric actuator 111 overlapping in the vertical direction with the first pressure chambers 21*a* and the second pressure chambers 21*b* forming a certain individual channel 20 is not likely to be transmitted to parts of the piezoelectric actuator 111 overlapping in the vertical direction with the first pressure chambers 21*a* and the second pressure chambers 21*b* forming another individual channel 20. As a result, the crosstalk can be inhibited effectively.

Also in the first modified embodiment, each part of the upper surface of the piezoelectric actuator 12 positioned between the piezoelectric elements 12*x*1 and 12*x*2 adjacent to each other (each part adhering to the first partition wall 13*b*) is flat. Thus, it is possible to uniformly apply load to the first partition walls 13*b* when the first partition walls 13*b* of the protective member 13 are joined to the parts of the upper surface of the piezoelectric actuator 12 overlapping in the vertical direction with the second partition walls 11*a*2.

In the above embodiment and the first modified embodiment, the slits 12*c*1 are formed in the piezoelectric layer 12*c*. The present disclosure, however, is not limited thereto. No slits may be formed in the piezoelectric layer 12*c*, and an entire upper surface of the piezoelectric layer 12*c* may be flat.

In the above embodiment and the first modified embodiment, the parts of the upper surface of the piezoelectric actuator 12 joined to the first partition walls 13*b* are flat. The present disclosure, however, is not limited thereto. The parts of the upper surface of the piezoelectric actuator 12 joined to the first partition walls 13*b* may be slightly rough.

Second Modified Embodiment

In the above embodiment, the traces 12*e* connected to the piezoelectric elements 12*x*1 corresponding to the individual channel row 20A and the traces 12*e* connected to the piezoelectric elements 12*x*2 corresponding to the individual channel row 20B are pulled out to the part of the piezoelectric actuator 12 between the individual channel row 20A and the individual channel row 20B in the conveyance direction. The ends of the traces 12*e* are the contacts 12*f*. Further, the through hole 13*y* extending continuously over the contacts 12*f* is formed in the part of the protective member 13 between the individual channel row 20A and the individual channel row 20B. The trace substrate 18 is connected to the contacts 12*f* through the through hole 13*y*. The present disclosure, however, is not limited thereto.

Figure 8:
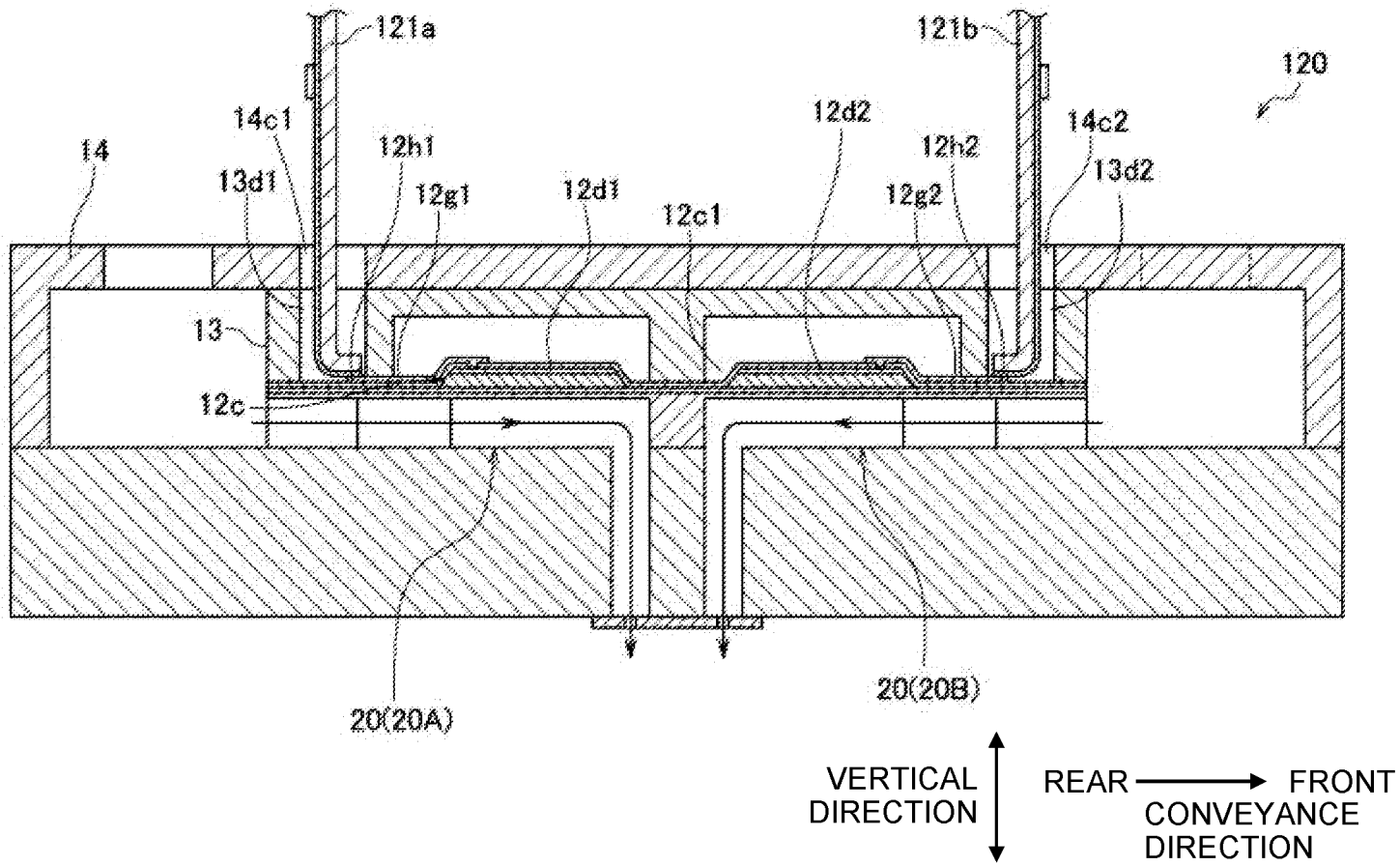
FIG. 8 is a cross-sectional view that corresponds to FIG. 3, depicting an ink-jet head according to a second modified embodiment.

For example, in an ink-jet head 120 as depicted in FIG. 8, traces 12*g*1 corresponding to the individual channel row 20A are pulled out rearward in the conveyance direction beyond the individual channel row 20A. Ends of the traces 12*g*1 are contacts 12*h*1. A through hole 13*d*1 extending continuously over the contacts 12*h*1 is formed at an end at the rear side in the conveyance direction of the protective member 13. Further, a through hole 14*c*1 is formed at a part of the manifold substrate 14 overlapping in the vertical direction with the through hole 13*d*1. Trace members 121*a* are connected to the contacts 12*h*1 through the through holes 13*d*1 and 14*c*1.

Traces 12*g*2 corresponding to the individual channel row 20B are pulled out frontward in the conveyance direction beyond the individual channel row 20B. Ends of the traces 12*g*2 are contacts 12*h*2. A through hole 13*d*2 extending continuously over the contacts 12*h*2 is formed at an end at the front side in the conveyance direction of the protective member 13. A through hole 14*c*2 is formed at a part of the manifold substrate 14 overlapping in the vertical direction with the through hole 13*d*2. Trace members 121*b* are connected to the contacts 12*h*2 through the through holes 13*d*2 and 14*c*2.

Third Modified Embodiment

Figure 9:
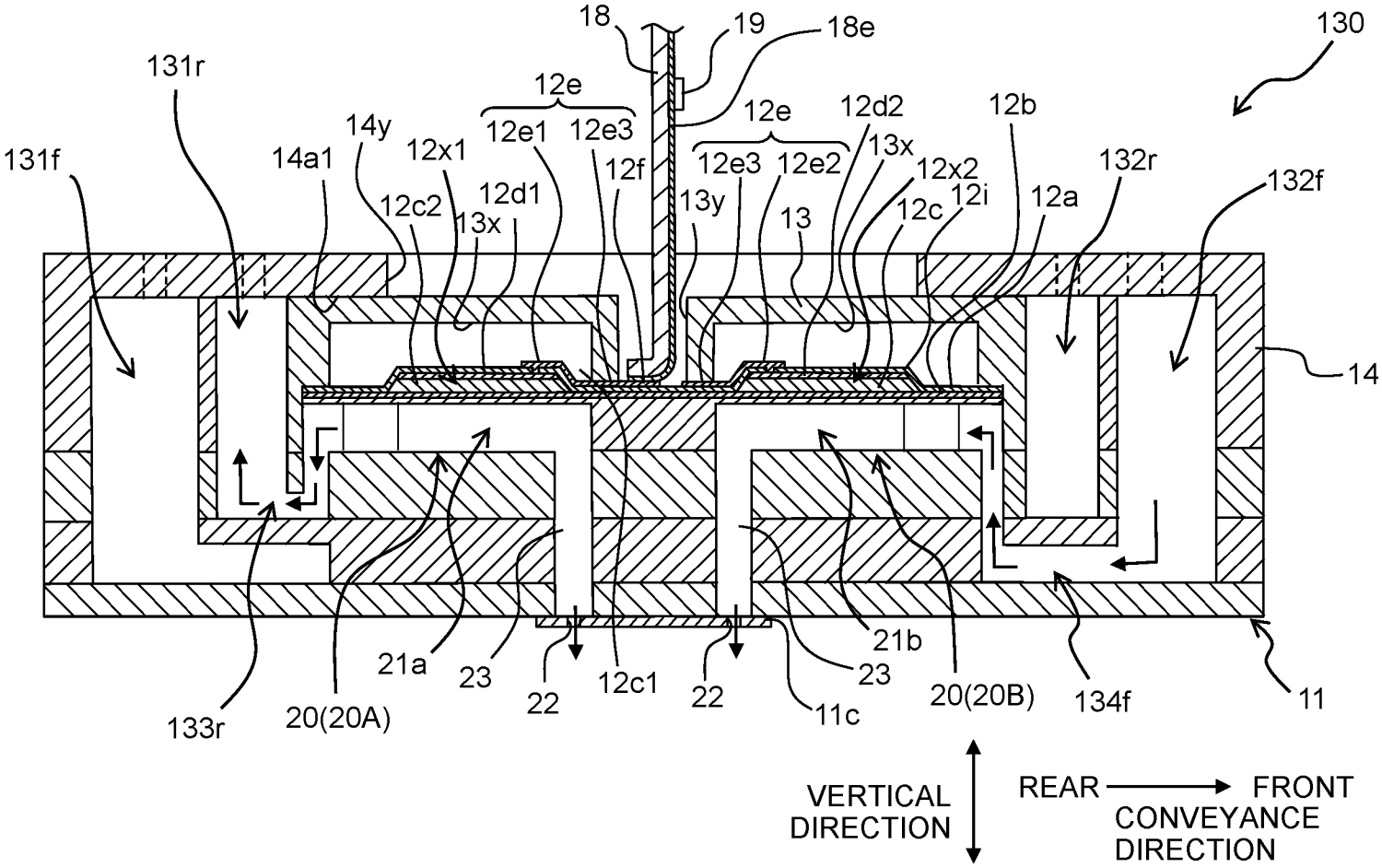
FIG. 9 is a cross-sectional view that corresponds to FIG. 3, depicting a circulation-type ink-jet head.

The present disclosure is applicable to a circulation-type liquid discharge head. Referring to FIG. 9, a circulation-type ink-jet head 130 according to a third modified embodiment is explained. The ink-jet head 130 has a similar structure as the ink-jet head 1, except that a supply manifold 131*f* and a return manifold 131*r* are provided instead of the manifold 31 and that a supply manifold 132*f* and a return manifold 132*r* are provided instead of the manifold 32. The constitutive parts or components, which are the same as or equivalent to those of the ink-jet head 1, are designated by the same reference numerals, any explanation therefor is omitted.

As depicted in FIG. 9, the supply manifold 131*f* and the return manifold 131*r* are arranged in the conveyance direction. Similarly, the supply manifold 132*f* and the return manifold 132*r* are arranged in the conveyance direction. The supply manifold 132*f* communicates with the pressure chamber 21*b* via a supply channel 134*f*. The supply channel 134*f* extends rearward in the conveyance direction from a lower side of the supply manifold 132*f*, and then extends upward to communicate with the pressure chamber 21*b*. Although not depicted in FIG. 9, the supply manifold 131*f* communicates with the pressure chamber 21*b* via a supply channel similar to the supply channel 134*f*.

As depicted in FIG. 9, the return manifold 131*r* communicates with the pressure chamber 21*a* via a return channel 133*r*. The return channel 133*r* extends frontward in the conveyance direction from a lower side of the supply manifold 131*r*, and then extends upward to communicate with the pressure chamber 21*a*. Although not depicted in FIG. 9, the return manifold 132*r* communicates with the pressure chamber 21*a* via a return channel similar to the return channel 133*r*.

Ink in the supply manifold 132*f* flows through the supply channel 134*f* and is supplied to the pressure chamber 21*b*. Ink supplied to the pressure chamber 21*b* flows to the communication channel 23 and part of the ink is discharged from the nozzle 22. Ink not discharged from the nozzle 22 flows toward the pressure chamber 21*a* communicating with the same communication channel 23. Ink in the pressure chamber 21*a* flows to the return manifold 132*r* via a return channel (not depicted). Accordingly, ink supplied from the supply manifold 132*f* flows to the return manifold 132*r* after flowing through the pressure chamber 21*b* and the pressure chamber 21*a*.

Similarly, ink in the supply manifold 131*f* flows through a supply channel (not depicted) and is supplied to the pressure chamber 21*b*. Ink supplied to the pressure chamber 21*b* flows to the communication channel 23 and part of the ink is discharged from the nozzle 22. Ink not discharged from the nozzle 22 flows toward the pressure chamber 21*a* communicating with the same communication channel 23. Ink in the pressure chamber 21*a* flows to the return manifold 131*r* via the return channel 133*r*. Accordingly, ink supplied from the supply manifold 131*f* flows to the return manifold 131*r* after flowing through the pressure chamber 21*b* and the pressure chamber 21*a*.

The flowing of ink from each of the supply manifolds 131*f* and 132*f* to the corresponding one of the return manifolds 131*r* and 132*r* is caused as described above. This inhibits ink in the vicinity of the nozzle 22 from staying there for a long time, thereby making it possible to inhibit the increase in viscosity of ink in the vicinity of the nozzle 22.

In the above embodiment, the plate 11*a*, the piezoelectric actuator 12, and the protective member 13 have the same exterior form. The present disclosure, however, is not limited thereto. From among the above members (the plate 11*a*, the piezoelectric actuator 12, and the protective member 13), some members may have the same external form. Or, all the members may have different external forms.

In the above embodiment, the height H of the first partition walls 13*b* is equal to or more than 10 μm and equal to or less than 30 μm. The present disclosure, however, is not limited there to. The height H of the first partition walls 13*b* may be less than 10 μm or longer than 30 μm.

In the above embodiment, the width W1 of the first partition walls 13*b* is narrower than the width W2 of the second partition walls 11*a*1 and 11*a*2. The present disclosure, however, is not limited thereto. The width W1 of the first partition walls 13*b* may be the same as the width W2 of the second partition walls 11*a*1 and 11*a*2. The width W1 of the first partition walls 13*b* may be equal to or more than the width W2 of the second partition walls 11*a*1 and 11*a*2.

The above explanation is made about the examples in which the present disclosure is applied to the line head. The present disclosure, however, is not limited thereto. The present disclosure may be applied to a so-called serial head that is carried on a carriage and that discharges ink from nozzles while moving together with the carriage.

The present disclosure can be applied to any other apparatus than the ink-jet head configured to discharge ink from nozzles. For example, the present disclosure can be applied to a liquid discharge head configured to discharge any other liquid than ink.

What is claimed is:

1. A liquid discharge head, comprising:

a channel unit including a liquid channel that includes a plurality of pairs of pressure chambers;

a piezoelectric actuator disposed at a first side in a first direction of the channel unit, the piezoelectric actuator including: a plurality of piezoelectric elements overlapping with the pressure chambers in the first direction; and a vibration film disposed between the piezoelectric elements and the channel unit in the first direction and covering the pressure chambers; and a protective member joined to a surface, of the piezoelectric actuator, at the first side in the first direction and forming a plurality of accommodation spaces in which the piezoelectric elements are accommodated, wherein the plurality of pairs of the pressure chambers are arranged in a second direction that is orthogonal to the first direction, each of the pairs of the pressure chambers includes a first pressure chamber and a second pressure chamber disposed at a first side in the second direction of the first pressure chamber, wherein the liquid channel includes:

a plurality of nozzles respectively corresponding to the pairs of the pressure chambers; and a plurality of communication channels respectively corresponding to the pairs of the pressure chambers, each of the communication channels allowing the first pressure chamber, the second pressure chamber, and the nozzle to communicate with each other, wherein the protective member includes a plurality of first partition walls joined to the surface at the first side in the first direction of the piezoelectric actuator and separating the accommodating spaces from each other, wherein each of the first partition walls is provided between a first pressure chamber and a second pressure chamber, which belong to different pairs of the pressure chambers included in the pairs of the pressure chambers, in the second direction, and wherein each of the first partition walls is not provided between a first pressure chamber and a second pressure chamber, which belong to an identical pressure chamber pair included in the pairs of the pressure chambers, in the second direction.

2. The liquid discharge head according to claim 1, wherein the channel unit includes a plurality of second partition walls each positioned between pressure chambers that are included in the pressure chambers and are adjacent to each other in the second direction, each of the second partition walls separating the pressure chambers adjacent to each other in the second direction from each other, and wherein the first partition walls are shorter in the second direction than the second partition walls.

3. The liquid discharge head according to claim 2, wherein a length in the first direction of the first partition walls is equal to or more than 10 μm and equal to or less than 30 μm.

4. The liquid discharge head according to claim 1, wherein the channel unit includes a pressure chamber member defining the pressure chambers, and wherein the pressure chamber member, the piezoelectric actuator, and the protective member have an identical shape as viewed in the first direction.

5. The liquid discharge head according to claim 1, wherein the channel unit includes two pressure chamber rows arranged at an interval in a third direction that is orthogonal to the first direction and the second direction, wherein each of the pressure chamber rows includes the pairs of the pressure chambers arranged in the second direction, wherein the piezoelectric actuator includes a plurality of traces pulled out from the piezoelectric elements to a part of the piezoelectric actuator between the two pressure chamber rows in the third direction, wherein parts of the traces positioned between the two pressure chamber rows in the third direction in the vibration film are a plurality of contacts with which electrical connection to the outside is performed, and wherein a through hole passing through the protective member in the first direction is formed at a part of the protective member overlapping in the first direction with the contacts, the through hole extending over the contacts.

6. The liquid discharge head according to claim 1, wherein a surface at the first side in the first direction of a part of the piezoelectric actuator overlapping in the first direction with each of the first partition walls is flat.

7. The liquid discharge head according to claim 1, wherein the piezoelectric actuator includes a piezoelectric layer disposed at the first side in the first direction of the vibration film and extending over the pressure chambers, wherein a part of the piezoelectric layer overlapping in the first direction with each of the pressure chambers forms a part of each of the piezoelectric elements, and wherein a slit is formed at a part of the piezoelectric layer between the first pressure chamber and the second pressure chamber, which belong to an identical pressure chamber pair included in the pairs of the pressure chambers, in the second direction, and the slit is not formed at a part of the piezoelectric layer between the first pressure chamber and the second pressure chamber, which belong to different pairs of the pressure chambers included in the pairs of the pressure chambers, in the second direction.

* * * * *